US009446830B2

(12) United States Patent
Hartmeyer et al.

(10) Patent No.: US 9,446,830 B2
(45) Date of Patent: Sep. 20, 2016

(54) BOAT DRIVE WITH COOLING CIRCUIT

(71) Applicant: Torqeedo GmbH, Gilching (DE)

(72) Inventors: Marc Hartmeyer, Munich (DE); Jens Biebach, Tutzing (DE)

(73) Assignee: Torqeedo GmbH, Gilching (DE)

( * ) Notice: Subject to any disclaimer, the term of this patent is extended or adjusted under 35 U.S.C. 154(b) by 43 days.

(21) Appl. No.: 14/621,085

(22) Filed: Feb. 12, 2015

(65) Prior Publication Data

US 2015/0232163 A1 Aug. 20, 2015

(30) Foreign Application Priority Data

Feb. 14, 2014 (EP) ..... 14000540

(51) Int. Cl.
*B63H 21/17* (2006.01)
*B63H 20/28* (2006.01)

(52) U.S. Cl.
CPC ..... *B63H 20/28* (2013.01); *B63H 20/285* (2013.01); *B63H 21/17* (2013.01)

(58) Field of Classification Search
CPC ..... B63H 21/17; B63H 20/28
USPC ..... 440/6, 1
See application file for complete search history.

(56) References Cited

U.S. PATENT DOCUMENTS 5,366,393 A * 11/1994 Uenage ..... B63H 20/10 440/1
6,155,895 A * 12/2000 Sato ..... F01P 1/10 123/195 P
6,346,018 B1 * 2/2002 Watanabe ..... F02B 61/045 123/195 P
6,364,726 B1 * 4/2002 Motose ..... F02B 61/045 440/86
6,513,463 B2 * 2/2003 Katayama ..... F01P 3/202 123/41.29
6,685,515 B1 * 2/2004 Satoh ..... B63H 21/213 440/2
6,918,802 B2 * 7/2005 Watabe ..... F02B 61/045 123/179.1
8,298,023 B2 * 10/2012 Daikoku ..... B63H 20/20 440/3
8,333,626 B2 * 12/2012 Daikoku ..... B63H 20/30 440/3
8,535,104 B1 * 9/2013 Nida ..... B63H 21/383 180/68.2
8,727,820 B2 * 5/2014 Stasolla ..... B63H 21/20 440/3
2011/0195620 A1 * 8/2011 Davis ..... B63H 20/14 440/75
2015/0232163 A1 * 8/2015 Hartmeyer ..... B63H 20/28 440/6

* cited by examiner

*Primary Examiner* — Lars A Olson
*Assistant Examiner* — Jovon Hayes
(74) *Attorney, Agent, or Firm* — Crowell & Moring LLP

(57) ABSTRACT

A cooling system and method is disclosed. A coolant line is in thermal contact with an electric motor of a boat drive. Coolant is pump able by a pump through the coolant line. The coolant line is in thermal contact with a component that is spatially separate from the boat drive. The coolant line has a first line section which is in thermal contact with the electric motor, a second line section which is in thermal contact with the component, and the first line section is detachably connectable to the second line section.

13 Claims, 1 Drawing Sheet

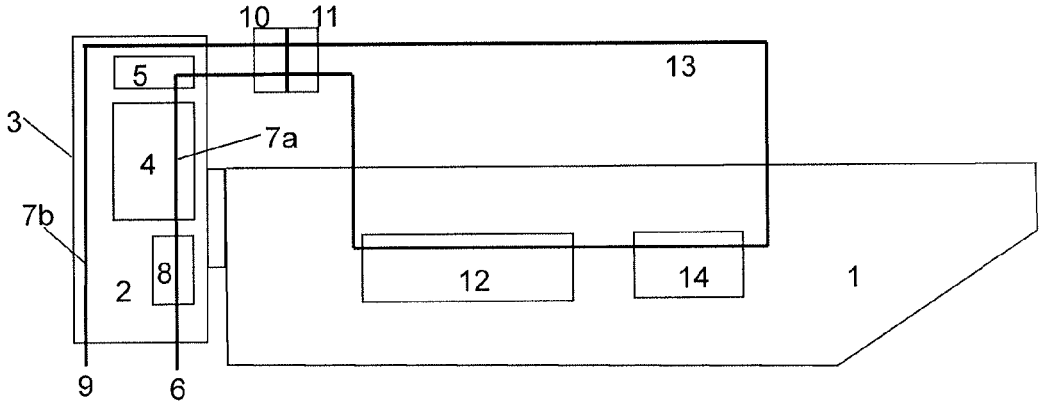
10
11
13
5
3
7a
4
7b
8
2
12
14
1
9
6

BOAT DRIVE WITH COOLING CIRCUIT

This application claims the priority of European Patent Document No. EP 14000540.6, filed Feb. 14, 2014, the disclosure of which is expressly incorporated by reference herein.

BACKGROUND AND SUMMARY OF THE INVENTION

The invention relates to a boat drive, in particular an outboard drive, having an electric motor and having a coolant line which is in thermal contact with the electric motor and which has a coolant inlet and a coolant outlet, wherein a pump is provided for pumping coolant for cooling the electric motor through the coolant line. Furthermore, the invention relates to a method for cooling a component situated on a boat, wherein the boat has a boat drive which is cooled by means of a coolant, and wherein the component is spatially separate from the boat drive.

Outboard drives for boats are normally equipped with a cooling circuit. Water is drawn in by means of a pump and supplied to the motor via a coolant line. The coolant line is in thermal contact with the motor, such that the motor and the coolant exchange heat and the motor is cooled.

In the case of electric outboard drives, it is often necessary to cool not only the electric motor but also the battery which provides the electrical supply for the electric motor. Cooling of the battery by convection, that is to say by means of air flowing past, necessitates relatively large cooling surfaces, which are generally not available in a boat.

U.S. Pat. No. 8,535,104 B1 has disclosed a cooling system for a boat battery, wherein the battery is cooled by means of cooling air, which in turn is cooled by sea water.

The supply of the water into the interior of the boat to the battery however often poses problems such as for example leaks, corrosion or electrolysis, and leads to increased maintenance outlay.

It is therefore an object of the present invention to provide a boat drive and a corresponding method, which permit improved cooling of the battery or of other components situated in the boat.

This object is achieved by means of a boat drive, in particular an outboard drive, having an electric motor and having a coolant line which is in thermal contact with the electric motor, wherein a pump is provided for pumping coolant for cooling the electric motor through the coolant line, wherein a further component to be cooled is provided, which further component is spatially separate from the boat drive, and the coolant line is in thermal contact with the further component, and wherein the coolant line has a first line section which is in thermal contact with the electric motor, and wherein the coolant line has a second line section which is in thermal contact with the further component, wherein the first line section and the second line section are detachably connected to one another.

In an electric boat drive, a cooling circuit is normally already installed. The cooling circuit comprises a coolant line through which coolant is pumped, which coolant cools the electric motor. For this purpose, the coolant line is arranged such that it is in thermal contact with the electric motor and heat is exchanged between the electric motor and the coolant flowing through the coolant line.

Aside from the electric motor, there are further components in the boat, such as for example a battery, which must be cooled but which are arranged spatially distant from the boat drive. The expression "spatially distant" or "spatially separate" is also intended to encompass an arrangement in which the distance between the electric motor and the further component is greater than 100 cm, greater than 150 cm or greater than 200 cm, and in particular an arrangement in which the further component is situated in the interior of the boat. This is also to be understood to mean an arrangement in which the boat drive is equipped with a housing in which the electric motor is situated, and wherein the further component is provided outside the housing.

According to the invention, the coolant line is also led to the further component and placed in thermal contact therewith. The further component is thus incorporated into the cooling circuit of the electric motor. It is thus possible to dispense with a separate cooling means for the further component.

In one variant of the invention, the coolant is supplied firstly to the electric motor and subsequently to the further component. Conversely, the coolant line may also be provided such that the coolant is supplied firstly to the further component and subsequently to the electric motor. Alternatively, the electric motor and the further component may also be cooled in parallel. In the latter case, the coolant line is divided into two or more parallel segments which lead to the electric motor and to one or more further components respectively.

The invention has significant advantages in relation to a separate water-type cooling arrangement for the further component. The supply of coolant is performed via the coolant line provided for the electric motor, such that no separate supply of water from the outside into the boat interior needs to be established. Correspondingly, the coolant that has been heated by the further component can also be discharged via the coolant line.

The invention can be used in all types of electric boat drives, for example inboard or outboard boat drives. Particular advantages are attained in the case of outboard drives.

In a preferred embodiment of the invention, water is used as coolant, in particular water from the body of water surrounding the boat.

The invention is advantageously used for the cooling of a battery provided for the supply of electricity to the electric motor, in particular for the cooling of a battery situated in the interior of the boat. It is also expedient for the battery to be cooled during times in which it is not being utilized, that is to say when the electric motor is not in operation. In this way, calendrical aging of the battery can be reduced.

A further advantageous use of the invention relates to the cooling of a battery charging unit situated on board the boat. The weight and size of a battery charging unit equipped with a liquid-type cooling arrangement, in particular water-type cooling arrangement, can be made smaller, thus providing increased flexibility with regard to installation location.

In other embodiments, it is alternatively or additionally the case that further components in the boat, for example a generator, an air-conditioning system, a heat pump or a refrigerator, are cooled in accordance with the invention.

It is optionally also possible for an additional heater to be provided for the battery and/or for the further components in order for these to be brought to operating temperature more quickly. In the presence of very high air humidity levels, and when there is a high temperature difference between the cooled surfaces and the ambient air, condensation or dew forms on the cooled surfaces, which is undesirable specifically in the case of electrical components such as, for example, a battery. In this case, through targeted use of the waste heat of the motor, it may be possible to increase the coolant temperature to a value at which the formation of dew on the cooled components does not occur. If even more effective temperature control of the coolant is necessary, the addition of an auxiliary heater in addition or alternatively to the utilization of the waste heat of the motor may be advantageous.

According to the invention, the coolant line has a first line section and a second line section. The first line section is in thermal contact with the electric motor and the second line section is in thermal contact with the further component. The first and second line sections are in this case detachably connected to one another. In this embodiment, the conventional cooling circuit for the electric motor, which constitutes the first line section, is equipped with connection elements to which the second line section can be connected.

The connection of the first and second line sections is realized preferably by means of a plug-type, screw-type or bayonet-type connection. Such connecting elements are preferably of self-closing design, such that no coolant escapes from the connecting elements in the event of separation of the line sections.

It is also possible for the entire coolant circuit to be fixedly installed in the boat. The original coolant line, which was provided only for the cooling of the electric motor, is extended so as to also be in thermal contact with one or more further components, such that these arc likewise cooled by the coolant.

As described above, the invention is suitable in particular for the cooling of the battery. In this case, the battery must also be electrically connected to the boat drive, specifically to the electric motor. In this case, it is expedient for a combination connecting element to be provided which simultaneously produces the electrical connection between the battery and the boat drive and the connection between the first and second line sections. The combination connecting element simultaneously permits the connection of the battery to the cooling circuit of the electric motor and the electrical connection between the battery and the electric motor. The combination connecting element may have not only the coolant connection but also multiple electrical terminals for low-voltage and high-voltage connections. The combination connecting element may self-evidently also be used for the connection of other components which are to be both connected to the cooling circuit and electrically connected to the boat drive. By means of self-closing water connecting elements, it can additionally be ensured that the electrical contacts of the combination connecting element do not come into contact with water.

It is advantageous for the coolant line to be equipped with a monitoring device for monitoring the throughflow, the pressure and/or the temperature. The monitoring device can measure and/or display the stated variables throughflow, pressure and/or temperature or may also be connected to regulating elements which can serve for manipulating the coolant flow.

The coolant line preferably has a coolant inlet and a coolant outlet via which cooling water is drawn in from outside the boat and, after the cooling of the electric motor and of the further component(s), is discharged again.

The cooling circuit may be in the form of a single-circuit system or dual-circuit system. In the case of a single-circuit system, cooling water is drawn in by means of a pump, conducted via the coolant line to the electric motor and to the one or more further component(s), and subsequently discharged again to the surroundings, generally to the water surrounding the boat. In this case, the further component is either connected in series with the electric motor in the coolant line, or the coolant line is split into two or more parallel line sections which serve for the cooling of the electric motor and of one or more further component(s).

In the case of a specific form of the single-circuit system, the shaft of the outboard motor functions as a heat exchanger. This embodiment is particularly suitable for outboard motors and is advantageous for example if the boat has to be used on bodies of water that have been contaminated with combustible liquids, a situation which may for example apply to firefighting vessels.

In this embodiment, a closed coolant circuit exists to which the electric motor, various other components to be cooled situated in the direct vicinity of the electric motor, and also components to be cooled which are situated on the boat itself, and which are connected by means of the coolant line to the electric motor of the outboard motor, are connected. After the coolant of the closed coolant circuit has passed through all of the components to be cooled, the coolant line is led within the motor shaft of the outboard drive, below the shaft surface such that optimum heat transfer from the coolant to the body of water in which the shaft is situated is attained. To optimize the heat transfer, the outer surface of the motor shaft may for example be enlarged by means of fins. The fins should be applied such that the adverse hydrodynamic effect is minimal.

In the case of a dual-circuit system, the cooling water supplied from the outside serves for the cooling of a secondary closed coolant circuit by means of which the electric motor and/or the further components are cooled. In this case, it is also possible for multiple secondary cooling circuits to be provided for the cooling of the electric motor and of the further components.

If a higher level of cooling power is required, it may be expedient for the second line section of the coolant line to be equipped with a separate coolant inlet and/or a separate coolant outlet. The coolant, that is to say in this case water from the body of water surrounding the boat, is then drawn in or supplied not only via the coolant inlet of the first line section but also via the separate coolant inlet. In this way, a greater amount of coolant can be made available for cooling purposes.

In the case of elevated cooling demand, it is furthermore advantageous for a second pump to be provided in the second line section. A second line section is connected to the first line section, which corresponds to the existing cooling circuit for the electric motor, and a second pump is used to boost the coolant circulation. Impeller-type pumps, electric pumps or regenerative pumps, for example, may be used as pumps both in the first line section and in the second line section.

In the case of relatively low demand for cooling power, a reduction in rotational speed of the pump may be expedient in order to increase system efficiency. Optimum system efficiency is achieved through the use of a rotational speed-regulated pump, wherein the pump rotational speed is regulated in a manner dependent on the temperatures of the components to be cooled, wherein, in general, the respectively most critical temperature is taken into consideration as the regulating variable.

In the event that the pump is directly driven by the motor shaft, the throughflow direction within the cooling system is dependent on the direction of travel. In this case, the pump must be operable in both directions. Since the pump nevertheless normally has a preferential direction, the pump is preferably installed such that the greater delivery rate and/or the greater efficiency is attained in the forward direction of travel. In any case, the two connections of the cooling circuit to the body of water, that is to say the coolant inlet and the coolant outlet, must be situated below the surface of the body of water in order to ensure that water is drawn in in both directions of travel.

The method according to the invention for cooling a component situated on a boat, wherein the boat has a boat drive which is cooled by means of a coolant, and wherein the component is spatially separate from the boat drive, and wherein the coolant is conducted from the boat drive to the component, is characterized in that the coolant line has a first line section which is in thermal contact with the electric motor, and in that the coolant line has a second line section which is in thermal contact with the further component, wherein the first and second line sections are detachably connected to one another.

According to the invention, the cooling circuit of the electric motor is directly or indirectly also used for the cooling of one or more further components, in particular of the battery provided for supplying power to the electric motor.

The invention makes it possible in a simple manner for an existing cooling circuit for the electric motor of a boat drive, in particular of an outboard drive, to be expanded such that further components, for example the battery, can be cooled. For this purpose, the existing coolant line, which then constitutes the first line section, has permanently or detachably connected to it a second line section which conducts the coolant to the one or more further component(s) to be cooled.

The invention and further advantageous details of the invention will be explained by way of example below on the basis of the schematic drawing.

BRIEF DESCRIPTION OF THE DRAWING

FIG. 1 shows a cooling arrangement according to an embodiment of the present invention.

DETAILED DESCRIPTION OF THE DRAWING

FIG. 1 schematically shows a boat 1 with an outboard drive 2. The outboard drive 2 is equipped with a housing 3 in which there is situated an electric motor 4 for driving the boat 1. The electric motor 4 is controlled by means of motor electronics 5. The motor electronics 5 are likewise accommodated in the housing 3.

The electric motor 4 and the motor electronics 5 are equipped with a water-type cooling arrangement. The water-type cooling arrangement comprises a coolant inlet 6 via which water can be drawn from outside the boat 1 into a first line section 7*a*, 7*b* of a coolant line. For this purpose, an impeller pump 8 is provided in the first line section 7*a*, 7*b*. The water that is drawn in is conducted firstly through the electric motor 4 and subsequently through the motor electronics 5, and is brought into heat-exchanging contact with the electric motor 4 and with the motor electronics 5 in order to cool these. The heated water is discharged to the surroundings again via a coolant outlet 9.

The first line section 7*a*, 7*b* is split up downstream of the motor electronics 5 such that two different subsections 7*a* and 7*b* are formed. The two ends of the subsections 7*a* and 7*b* end at a plug-type connecting element 10. By means of a second plug-type connecting element (not illustrated in the drawing) which can be plugged onto the plug-type connecting element 10, the two ends of the subsections 7*a*, 7*b* can be connected in terms of flow such that the coolant can flow via the subsection 7*a* into the subsection 7*b*.

The power supply to the electric motor 4 and to the motor electronics 5 is realized by means of a battery 12 which is arranged, at a distance from the outboard drive 2, in the interior of the boat. For the cooling of the battery 12, a second line section 13 is provided which is in thermal contact with the battery 12. The second line section 13 has two connection ends which end at a plug connector 11. The plug connector 11 can be connected to the plug-type connecting element 10, such that a continuous coolant line 7*a*, 13, 7*b* is produced.

The water drawn in via the coolant inlet 6 flows through the line section 7*a* and cools the electric motor 4 and the motor electronics 5. Subsequently, the coolant flows via the plug-type connection element 10 and the plug connector 11 into the second line section 13 in order to cool the battery 12. The heated coolant is then recirculated via the plug-type connecting element 10 and the plug connector 11 into the line section 7*b*, and is discharged via the coolant outlet 9.

As shown in FIG. 1, it is possible for further components to be connected into the second line section 13, in order for the further components to likewise be cooled. In the example, a generator 14 is provided in series with the battery 12 in terms of cooling.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cooling system, comprising:

a coolant line in thermal contact with an electric motor of a boat drive; and a pump, wherein coolant is pumpable by the pump through the coolant line;

wherein the coolant line is in thermal contact with a component that is spatially separate from the boat drive;

wherein the coolant line has a first line section which is in thermal contact with the electric motor, wherein the coolant line has a second line section which is in thermal contact with the component, and wherein the first line section is detachably connectable to the second line section.

2. The cooling system according to claim 1, wherein the component is a battery or a battery charging unit.

3. The cooling system according to claim 1, wherein the first line section and the second line section are detachably connectable by a plug connection.

4. The cooling system according to claim 1, further comprising a combination connecting element which simultaneously provides an electrical connection between the component and the boat drive and a detachable connection between the first line section and the second line section.

5. The cooling system according to claim 1, wherein the coolant line is equipped with a monitoring device and wherein a throughflow, a pressure and/or a temperature is monitorable by the monitoring device.

6. The cooling system according to claim 1, wherein the coolant line has a coolant inlet for a supply of cooling water as the coolant from a body of water surrounding a boat in which the cooling system is used and has a coolant outlet for a discharge of the cooling water into the body of water surrounding the boat.

7. The cooling system according to claim 6, wherein the second line section has a separate coolant inlet and/or a separate coolant outlet.

8. The cooling system according to claim 1, further comprising a second pump, wherein the second pump is disposed in the second line section.

9. The cooling system according to claim 1, wherein the boat drive is an outboard drive.

10. The cooling system according to claim 1, wherein the boat drive is an outboard drive, wherein the outboard drive comprises a motor shaft which projects into water surrounding a boat in which the cooling system is used, and wherein the coolant line forms a closed coolant circuit and is guided through the motor shaft such that the coolant exchanges heat with the water surrounding the boat.

11. A method for cooling a component on a boat, comprising the steps of:

cooling a boat drive of the boat by a coolant in a first line section of a coolant line; and conducting the coolant from the boat drive to the component through the coolant line and cooling the component by the coolant in a second line section of the coolant line, wherein the component is spatially separate from the boat drive;

wherein the first line section is detachably connectable to the second line section.

12. The method according to claim 11, further comprising the step of conducting the coolant from the component back to the boat drive.

13. The method according to claim 11, wherein water from a body of water surrounding the boat is used as the coolant.

* * * * *